US005146642A

United States Patent [19]

Mank et al.

[11] Patent Number: 5,146,642

[45] Date of Patent: Sep. 15, 1992

[54] POWERED SCRUB BRUSH

[75] Inventors: James F. Mank, Dublin; Michael D. Milosh; Timothy J. Carpenter, both of Columbus, all of Ohio

[73] Assignee: The United States of America as represented by the Secretary of the Army, Washington, D.C.

[21] Appl. No.: 706,487

[22] Filed: May 28, 1991

[51] Int. Cl.[5] ..... A46B 13/04

[52] U.S. Cl. ..... 15/24; 15/22.1; 15/50.3

[58] Field of Search ..... 15/24, 29, 50.1, 52, 15/22.1, 23, 28, 50.3

[56] References Cited

U.S. PATENT DOCUMENTS

| | | | |
|---|---|---|---|
| 1,479,272 | 1/1924 | Young | 15/29 |
| 1,922,238 | 8/1933 | Freed | 15/24 |
| 2,801,431 | 8/1957 | Eastis | 15/29 |
| 3,605,154 | 9/1971 | Dawkins | 15/24 |
| 4,461,052 | 7/1984 | Mostul | 15/24 |

FOREIGN PATENT DOCUMENTS

| | | | |
|---|---|---|---|
| 3628688 | 3/1988 | Fed. Rep. of Germany | 15/24 |

*Primary Examiner*—Edward L. Roberts

*Attorney, Agent, or Firm*—Anthony T. Lane; Edward Goldberg; Michael C. Sachs

[57] ABSTRACT

A powered scrub brush having a power head module, a brush head module, and an extension shaft module. The power head module includes a positive-displacement motor and a flow-control valve. The motor may be coupled directly to the brush head module or indirectly through one or more extension shaft modules. The power head module has a liquid discharge port that is connected to a liquid discharge tube on the extension shaft module that in turn is connected to a liquid sprayer having a nozzle on the brush head module. Mechanical power is transferred from the motor to the brush via an output shaft on the motor, a flexible shaft in the extension shaft module, and a shaft in the brush head module on which the brush is removably mounted. The powered scrub brush is manually operated by regulating a flow-control valve that is connected between a pressurized water source and an inlet port on the motor. As pressurized liquid flows through the motor, the brush will rotate and liquid will be discharged via the nozzle. In an alternate embodiment, the brush is eccentrically mounted for orbital motion. In this version, a counterweight provides dynamic balance.

6 Claims, 6 Drawing Sheets

POWERED SCRUB BRUSH

The Government has rights in this invention pursuant to Contract No. DAAA15-86-K-0005 awarded by the Department of the Army.

BACKGROUND OF THE INVENTION

1. Field of the Invention

The present invention relates to implements for brushing, scrubbing and cleaning and, more particularly, to a powered scrub brush having a liquid spray.

2. Description of the Prior Art

In the fields of scrubbing, brushing and cleaning, it been the general practice to employ powered scrub brushes to remove soil and other contaminants from the surfaces of vehicles and similar structures. Conventional powered scrub brushes are often combined with a water supply to provide hydraulic power for operating the brush while also supplying a water spray to wet the brush and/or the surface to be cleaned.

One prior art implement includes a hydraulically powered brush driven by a dynamic turbine which uses a liquid to convert hydraulic energy into mechanical energy for rotating the brush. The liquid is exhausted by the turbine directly onto the surface to be cleaned. The turbine, exposed to the atmosphere via the exhaust, is located directly next to the brush head assembly.

Although such devices have served the purpose, they have not proven entirely satisfactory under all conditions of service. Because of the location of the turbine, such implements often have inadequate weight distributions that can quickly cause operator fatigue. Also considerable difficulty has been experienced with many prior art brushing implements in obtaining sufficient cleaning power when used with some water sources. Further, many prior art implements lack the versatility required to obtain effective cleaning in many diverse cleaning applications.

SUMMARY OF THE INVENTION

The general purpose of this invention is to provide a powered scrub brush which embraces all of the advantages of similarly employed devices and possesses none of the aforedescribed disadvantages. To obtain this, the present invention contemplates a unique modular, powered brush arrangement with interchangeable brushes that can be used to convert the implement into a number of different configurations. More specifically, the powered scrub brush includes three basic modules: a power head module, a brush head module, and an extension shaft module.

The power head module includes a positive-displacement hydraulic motor and a flow-control valve. The motor converts incoming hydraulic energy into mechanical energy. The flow-control valve governs the amount of pressurized liquid entering the hydraulic motor, thus controlling the amount of hydraulic energy supplied to the motor and the resulting mechanical power. The hydraulic motor mechanical output can be transferred directly to the brush head module or transferred indirectly via the extension shaft module. The hydraulic fluid is exhausted as a liquid spray onto the brush head assembly and the surface being cleaned. The liquid spray reduces the bond between the contaminates and the surface being cleaned, and rinses the contaminates from the brush head and the surface.

The brush head module connects to the power head module with a quick coupler/uncoupler in a manner that allows the use of various brush head module configurations. The brush head module can provide orbital motion, rotary motion, or a combination of orbital and rotary motions. The brush head characteristics, such as diameter, length, bristle material,,and brush fill density, can be varied to accommodate a number of cleaning surface applications. Extensions, having idential quick couplers/uncouplers as used on the power head and brush head modules, can be used to increase the working reach and change the angle of the brush head.

DETAILED DESCRIPTION OF THE PREFERRED EMBODIMENTS

Figure 1:
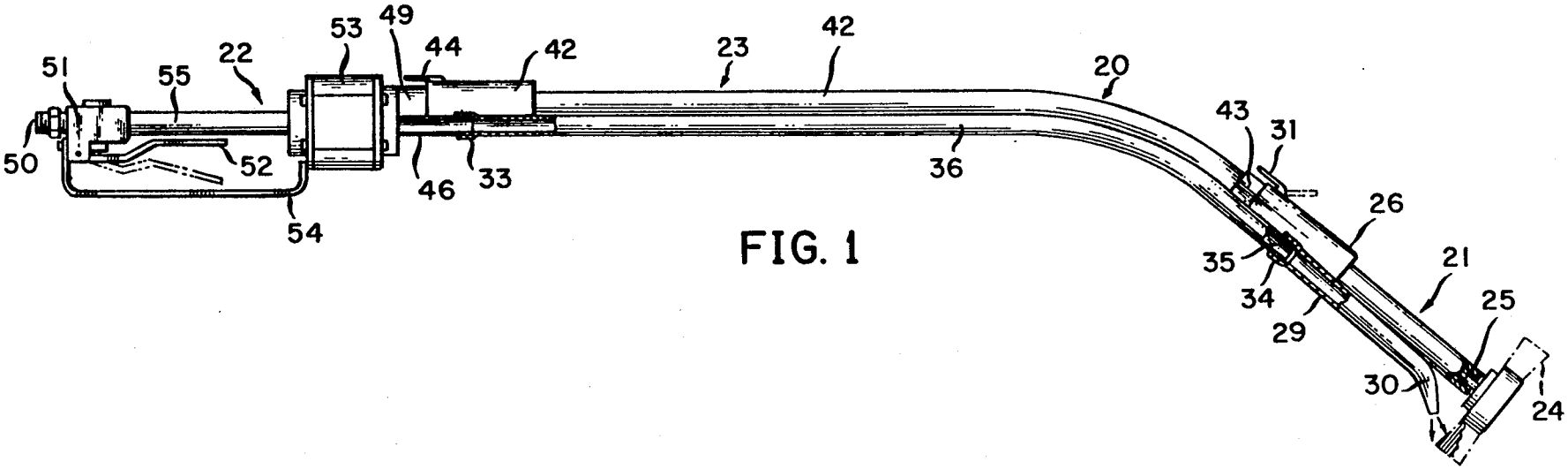
FIG. 1 is a side elevation, with parts broken away, of a preferred embodiment.
Figure 3:
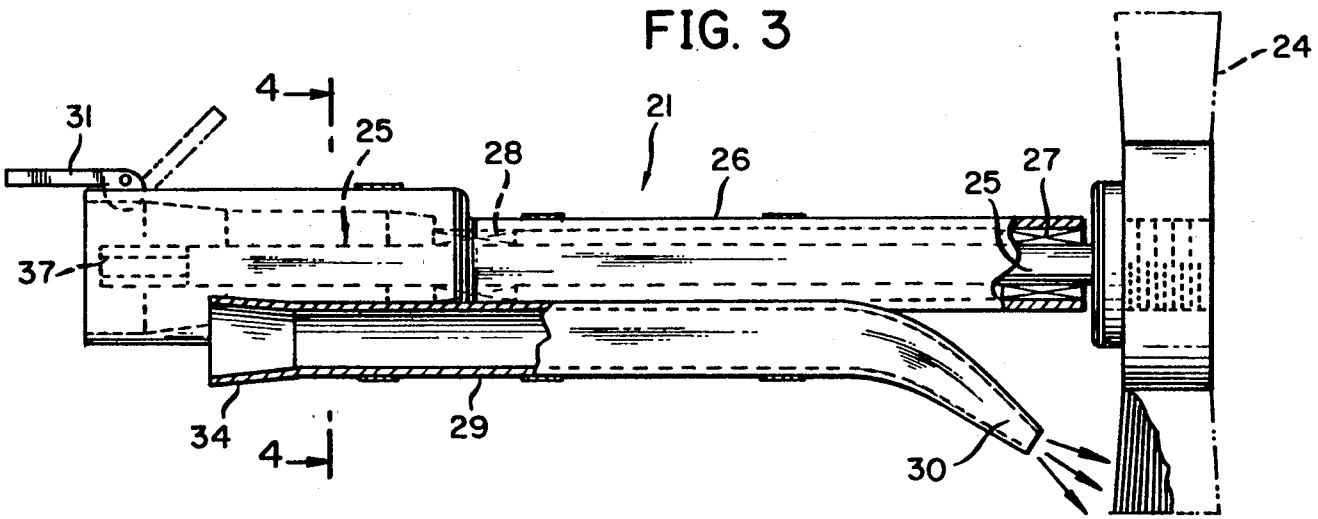
FIG. 3 is a side elevation, with parts broken away, of a portion of the device shown in FIG. 1.

Referring now to the drawings, there is shown in FIG. 1 a powered scrub brush assembly 20 comprising a brush head module 21, a power head module 22 and an extension shaft module 23. The brush head module 21 (FIG. 3) includes a wheel brush 24 joined to one end of a shaft 25 that is mounted for rotation in a shaft housing 26 via bearings 27, 28. A liquid discharge tube 29 is clamped to housing 26. Tube 29 terminates in a nozzle 30 that is angled toward the bristles of brush 24. A lock lever 31 is attached to the open end of housing 26 for use in locking the extension shaft module 23 thereto or, alternatively, locking the power head module 22 thereto.

Figure 2:
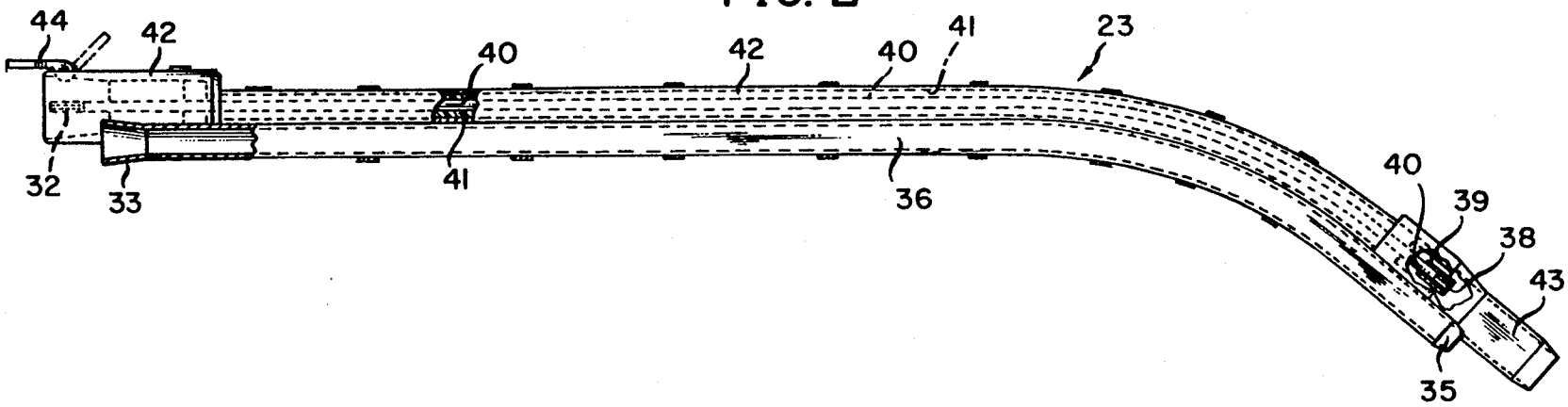
FIG. 2 is a side elevation, with parts broken away, of a portion of the device shown in FIG. 1.
Figure 6:
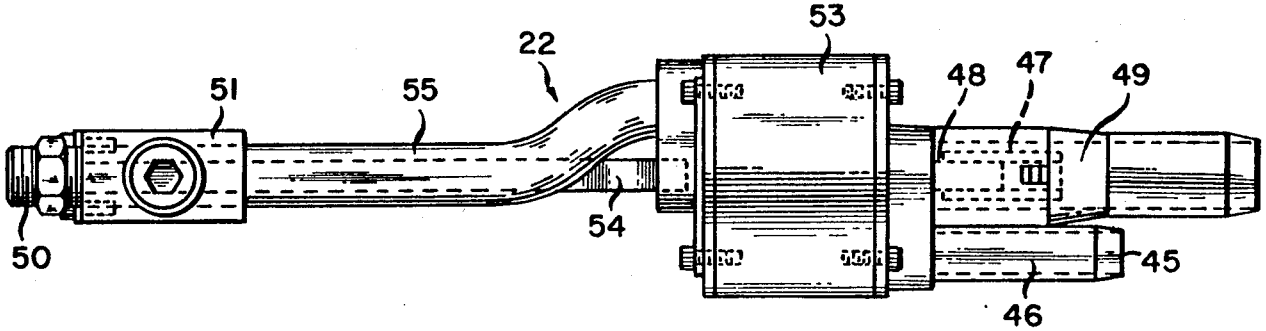
FIG. 6 is a top view of a portion of the device shown in FIG. 1.
Figure 7:
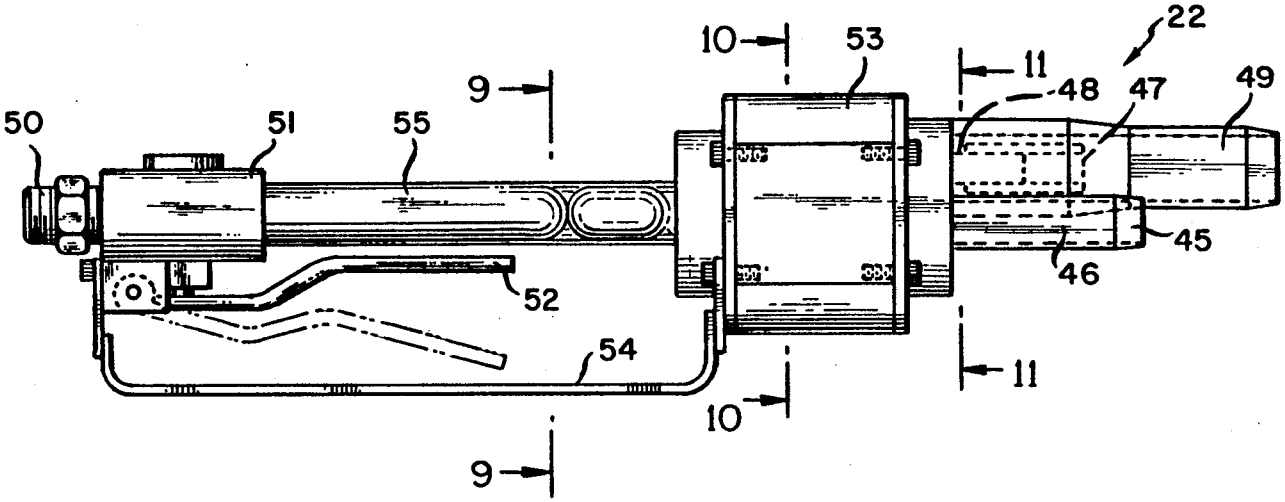
FIG. 7 is a side elevation of the device shown in FIG. 6.
Figure 8:
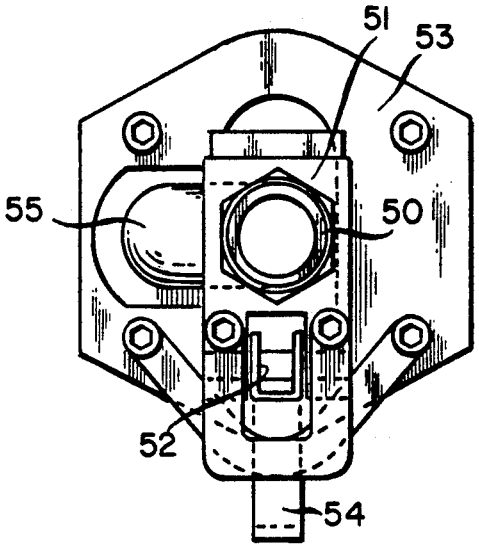
FIG. 8 is a rear elevation of the device shown in FIG. 7.
Figure 9:
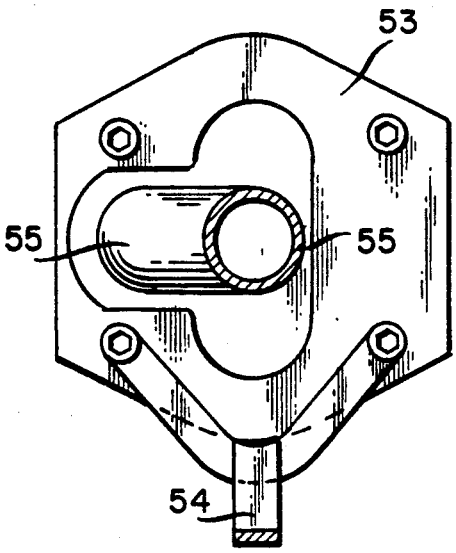
FIG. 9 is a sectional view taken on the line 9—9 of FIG. 7 and looking in the direction of the arrows.

FIG. 2 illustrates the details of the extension shaft module 23. A flexible shaft 40 and a continuous flexible bearing 41 are coaxially mounted in a rigid tubular housing 42 having a curved angled section. The shaft 40 may be made of wire closely coiled to form a flexible shaft. The tubular bearing 41 may be made of Teflon. A module coupler 43 is mounted at one end of housing 42. A lock lever 44 is mounted adjacent the open end of housing 42. A shaft coupler 39, fixed to one end of shaft 40, has a socket 38 for receiving the end of shaft 25 which has flat surfaces 37 (FIG. 3) for mating with corresponding surfaces in socket 38. A liquid discharge tube 36, clamped to the housing 42, is tapered at one end 35 to mate with the funneled end 34 of tube 29. Tube 36 has a funneled end 33 for receiving the tapered end 45 of the liquid discharge tube 46 on the power head module 22 (FIGS. 6, 7). The end of shaft 40 has flat surfaces 32 that are received in the socket of a shaft coupler 47 (FIGS. 6, 7) that is fixed to the output end of shaft 48.

The power head module 22 has a threaded coupler 50 for attaching a pressurized cleaning liquid (water) supply to the assembly 20. A liquid flow-control valve 51, having an on-off valve trigger 52, forms one end of module 22. A hydraulic drive motor 53 is rigidly attached to the body of valve 51 via a rigid U-shaped bar 54 and a rigid liquid supply tube 55.

Figure 10:
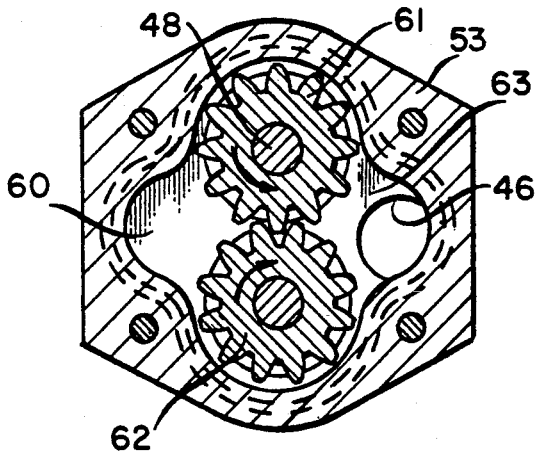
FIG. 10 is a section view taken on the line 10—10 of FIG. 7 and looking in the direction of the arrows.
Figure 11:
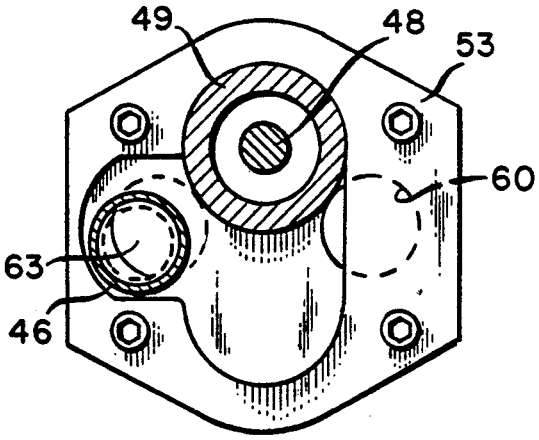
FIG. 11 is a section view taken on the line 11—11 of FIG. 7 and looking in the direction of the arrows.

Tube 55 is connected to an inlet port 60 of motor 53. The motor 53 is a positive-displacement motor that employs a drive gear 61 and an idler gear 6.2, each pivotably mounted to the body of motor 53 so that their teeth mesh. The gears 61, 62 separate the inlet port 60 from a liquid discharge port 63 (FIG. 10). The liquid discharge tube 46 communicates with the liquid discharge port 63 (FIG. 11). The shaft 48 is driven directly by the drive gear 61 to which it is fixed. A module coupler 49, one end of which is fixed to the motor 53, coaxially covers shaft 48 and shaft coupler 47.

The modules 21, 22, 23 are assembled by simply sliding their ends together to the position shown in FIG. 1. The extension shaft module 23 may be eliminated, permitting the brush head module 21 to be coupled directly to the power head module 22, e.g. see FIG. 12. When being assembled into the FIG. 1 configuration, the module coupler 43 is inserted into the open end of housing 26 while the tapered end 35 of the tube 36 slides into the funneled end 34 of tube 29. When properly coupled, the end of shaft 25 will reside in socket 38 of shaft coupler 39 and the tapered end 35 of tube 36 will form a liquid-tight seal with the end 34 of the tube 29. At this point, the lock lever 31 is rotated into its locking position (solid line in FIG. 1) to hold the modules 21, 23 in the assembled position. In like manner, the power head module 22 is coupled to the extension shaft module 23. More specifically, the module coupler 49 is inserted into the open end of housing 42 while the tapered end 45 of tube 46 is inserted into the funneled end 33 of tube 36. The ends of shafts 40, 48 are coupled via the socket in coupler 47 while the tapered end 45 of tube 46 makes a liquid-tight seal with the funneled end 33 of tube 36.

Figure 5:
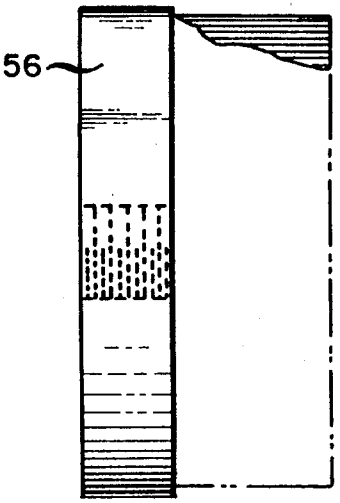
FIG. 5 is a side elevation, partly in phantom, of an accessory for use with the preferred embodiments.
Figure 4:
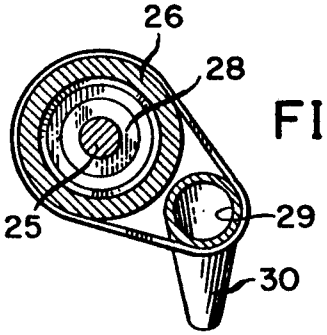
FIG. 4 is a section taken on the line 4—4 of FIG. 3 and looking in the direction of the arrows.

Finally, an appropriately shaped brush, for example wheel brush 24 or flat brush 56 (FIG. 5), is secured by threads or other means, onto the end of shaft 25. The threaded coupler 50 is attached to a source (not shown) of pressurized liquid such as water. The operator, grasping the assembly 20 at the module 22, directs the assembly 20 toward an object to be cleaned such as a motor vehicle or the like. By depressing the valve trigger 52 toward the tube 55, the operator can cause a measured amount of liquid flow to run through the assembly 20. The pressurized liquid will first encounter the gears 61, 62 after entering the inlet port 60 of motor 53. The pressurized liquid will cause the gears 61, 62 to rotate in the directions indicated by the arrows in FIG. 10 as it flows into the discharge port 63. The rotation of drive gear 61 will cause the brush 24 to rotate via shafts 48, 40, 25. After entering the discharge port 63, the liquid will flow through tubes 46, 36, 29 to be discharged from nozzle 30 onto the brush 24 and/or the object being cleaned.

Figure 12:
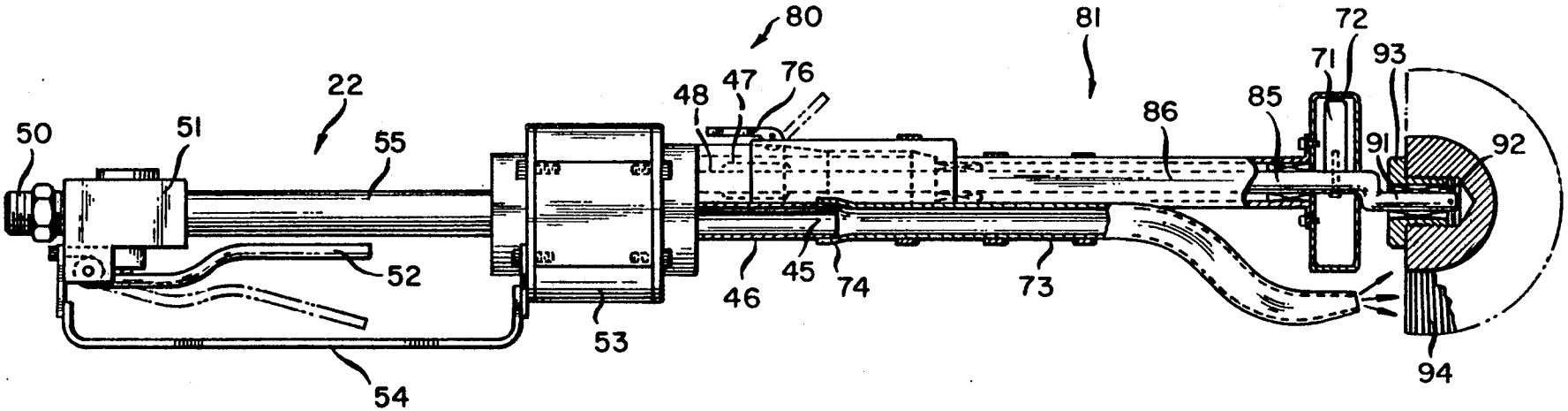
FIG. 12 is a side elevation, with parts broken away, of an alternate embodiment of the invention.
Figure 13:
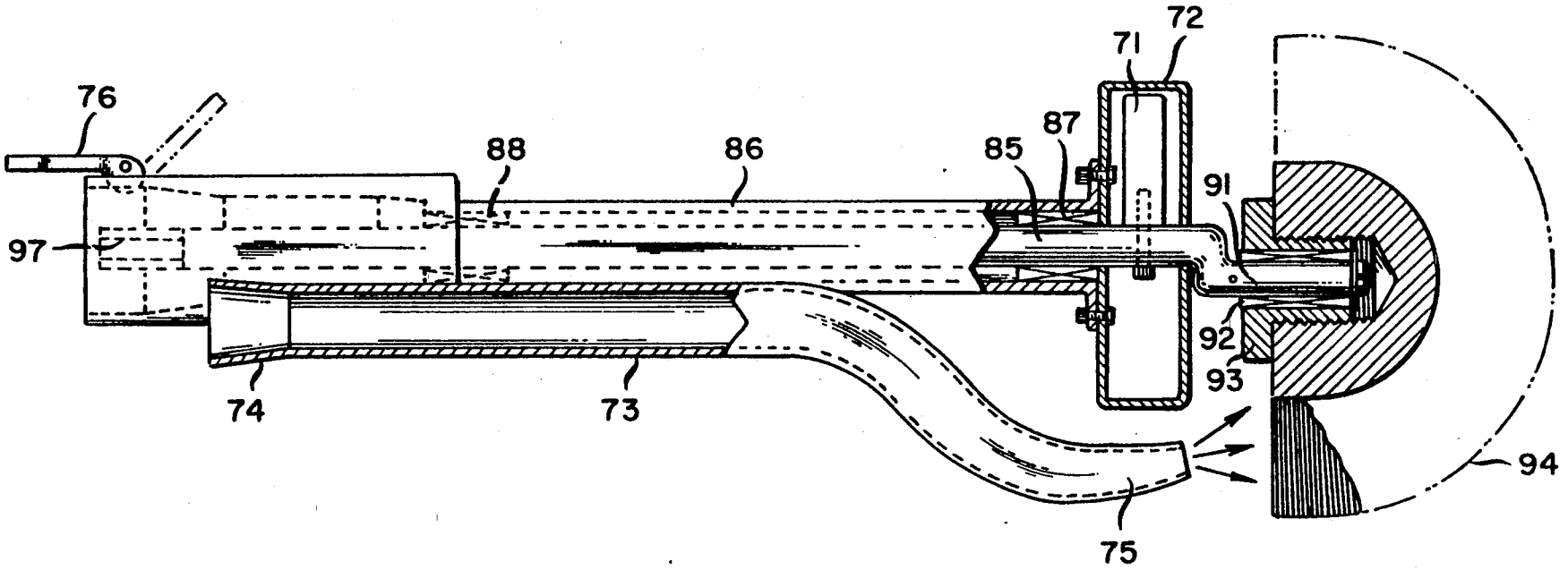
FIG. 13 is a side elevation, with parts broken away, of a portion of the device shown in FIG. 12.

FIGS. 12, 13 show an alternate embodiment of a brush head module 81 coupled and locked by lock lever 76 directly to the power head module 22 to form an assembly 80. The module 81 includes a shaft 85 mounted for rotation in a shaft housing 86 via a pair of bearings 87, 88. The shaft 85 has flat surfaces 97 at one end for cooperating with the similar surfaces in the shaft coupler 47. At its other end, the shaft 85 has an eccentric mounting stub 91 with a bearing 92 and a threaded sleeve 93 coaxially mounted thereon such that the sleeve 93 is free to rotate with respect to the stub 91. A brush, such as the round brush 94, is threaded onto the sleeve 93.

A counterweight 71 is attached to the shaft 85 to extend in the direction opposite to the eccentricity of stub 91. A counterweight housing 72 is fixed to shaft housing 86 and provides a protected space in which the counterweight 71 rotates. A liquid discharge tube 73, clamped to tube 86, has a funneled end 74 for receiving the tapered end 45, and a discharge end with a liquid discharge nozzle 75 that is directed at the brush 94.

The module 81, when driven by module 22, is designed to produce orbital-rotational motion of the round brush 94. The shaft 85 rotates the eccentric stub 91 and, therefore, the brush 94, about the longitudinal axis of shaft 85. Additionally, as it orbits about the axis of shaft 85, the brush 94 is free to rotate about the axis of stub 91. The rotating counterweight 71 is designed to produce a centrifugal force that balances the centrifugal force produced by the eccentrically mounted rotating brush 94.

Because the brush head modules 21, 81 connect to the power head module 22 with a quick coupler/uncoupler (lever 31, 76), various configurations may be easily assembled by an operator. Also, the positive-displacement hydraulic motor 53 provides greater cleaning power than a dynamic turbine from a given liquid supply having a specific liquid type, flow rate and pressure. However, it is also noted that a centrifugal motor could also be employed. Because the motor 53 allows the separation of the power head module 22 from the brush head modules 21, 81, the power head module 22 can be located close to the operator rather than at the brush head, as is the case in conventional devices This feature substantially improves the weight distribution of the assemblies 20, 80, and reduces the amount of operator effort required to support and manipulate the assemblies 20, 80. This feature significantly reduces operator fatigue. The assemblies 20, 80 may be operated from a conventional public water supply. A high pressure hydraulic supply or water source can be incorporated with this invention to allow the use of a small, lightweight motor, further reducing operator effort.

It is also noted that the power head module 22 is used primarily for supplying mechanical power to the brush head modules 21, 81. However, the power head module 22 may also be used for other applications as a universal, hand-operated driver or power source.

The assemblies 20, 80 may be used to clean a variety of objects using water and detergents. However, they will be particularly useful by the military for removing soil and other contaminants, including most chemical agents, from buildings, tanks, trucks, guns, motors and the like. The liquid spray can consist of water, chemicals (e.g. liquid detergents), or a chemical/water solution. The brush head characteristics such as diameter, length, bristle material and brush fill density can be varied to accommodate the various shapes of the surfaces to be cleaned. The working reach of the assemblies 20, 80 can be increased by connecting more than one extension shaft module 23 in series. The angle of the brush head may also be adjusted in this manner.

Obviously, many other modifications, variations and applications of the present invention are possible in the light of the above teachings. The foregoing disclosure and drawings are merely illustrative of the principle of this invention and are not to be interpreted in a limiting sense. It is to be understood that the invention should not be limited to the exact details of construction shown and described because obvious modifications will occur to a person skilled in the art.

What is claimed is:

1. A powered scrub brush comprising:

a hydraulic motor having a liquid inlet port, a liquid discharge port, and an output drive shaft;

a liquid flow control valve connected to said inlet port;

a brush head having a brush shaft, a brush coupler mounted on one end of said brush shaft, and a liquid sprayer; and means coupling said brush head to said motor for connecting said discharge port to said liquid sprayer and said brush shaft to said output drive shaft, said means coupling said brush head to said motor comprising an extension shaft module having an extension shaft and a liquid extension tube.

2. The brush of claim 1 wherein one end of said extension shaft is slideably coupled to said output drive shaft and the other end of said extension shaft is slideably coupled to said brush shaft.

3. The brush of claim 2, wherein one end of said liquid extension tube is slideably coupled to said liquid discharge port and the other end of said liquid extension tube is slideably coupled to said liquid sprayer.

4. The brush of claim 3 wherein said extension shaft module is nonlinear and said extension shaft is flexible.

5. A powered scrub brush comprising:

a hydraulic motor having a liquid inlet port, a liquid discharge port, and an output drive shaft;

a liquid flow control valve connected to said inlet port;

a brush head having a brush shaft, a brush coupler mounted on one end of said brush shaft, and a liquid sprayer; and means coupling said brush head to said motor for connecting said discharge port to said liquid sprayer and said brush shaft to said output drive shaft, wherein said means coupling said brush head to said motor comprises an extension shaft module having a tubular rigid housing, a tubular bearing mounted in said housing and a flexible shaft mounted in said bearing.

6. A powered scrub brush comprising:

a hydraulic motor having a liquid inlet port, a liquid discharge port, and an output drive shaft;

a liquid flow control valve connected to said inlet port;

a brush head having a brush shaft, a brush coupler mounted on one end of said brush shaft, and a liquid sprayer; and means coupling said brush head to said motor for connecting said discharge port to said liquid sprayer and said brush shaft to said output drive shaft, said means coupling said brush head including an eccentric shaft mounted for rotation in an orbit about the longitudinal axis of said brush shaft.

* * * * *